US009502795B1

(12) United States Patent
Wu

(10) Patent No.: US 9,502,795 B1
(45) Date of Patent: Nov. 22, 2016

(54) CLAMPING WIRE STRUCTURE OF TERMINAL BLOCK

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 15/054,838

(22) Filed: Feb. 26, 2016

(51) Int. Cl.
*H01R 4/24* (2006.01)
*H01R 9/24* (2006.01)

(52) U.S. Cl.
CPC ..... *H01R 9/2416* (2013.01)

(58) Field of Classification Search
CPC ..... H01R 4/4818
USPC ..... 439/441
See application file for complete search history.

(56) References Cited

U.S. PATENT DOCUMENTS 6,428,343 B1 * 8/2002 Landis ..... H01R 4/4827 439/440
6,893,286 B2 * 5/2005 Drewes ..... H01R 31/08 439/441
8,771,027 B2 * 7/2014 Zhang ..... H01R 4/4809 439/835
2008/0085639 A1 4/2008 Eppe et al.

FOREIGN PATENT DOCUMENTS

| | | | |
|---|---|---|---|
| CN | 104143712 | A | 11/2014 |
| DE | 10227235 | A1 | 1/2004 |
| DE | 102008047526 | A1 | 4/2010 |
| DE | 202013105944 | U1 | 1/2014 |
| DE | 202015003298 | U1 | 6/2015 |
| TW | I487208 | B | 6/2015 |

OTHER PUBLICATIONS

Search Report dated Aug. 5, 2016 of the corresponding European patent application.

* cited by examiner

*Primary Examiner* — Phuong Dinh
(74) *Attorney, Agent, or Firm* — Chun-Ming Shih; HDLS IPR Services

(57) ABSTRACT

A clamping wire structure of a terminal block includes an insertion base (10) and a spring (20). The insertion base (10) includes an insertion slot (12), a contact section (13), a linking piece (14), a first connection portion (15), an extension element (16), a connection slot (161), and a conductive pin (17). The insertion base (10) bends, so that the insertion slot (12) is positioned correspondingly above the extension element (16), and the linking piece (14) is inserted in the connection slot (161) to allow the insertion slot (12) and the extension element (16) to surroundingly form an insertion space (100). The spring (20) is bent into a V-shaped spring. The spring (20) is inserted in the insertion space (100).

9 Claims, 7 Drawing Sheets

1

CLAMPING WIRE STRUCTURE OF TERMINAL BLOCK

TECHNICAL FIELD

The present invention relates to a terminal structure and, in particular, to a clamping wire structure of a terminal block.

BACKGROUND

Normally, electronic components of electrical devices are electrically connected by connecting transmission lines so as to transmit data.

In order to achieve electrical connection or connection for data transmission, a wiring terminal serves as a connection structure between two elements. The conventional wiring terminal includes an insertion base and a spring. The insertion base and the spring are fixed by riveting or other fastening methods. Wires can be inserted into the wiring terminal and be clamped between the spring and the insertion base by means of a resilient force of the spring.

However, in the ROC patent no. I487208, the body of a wiring terminal is an open-type terminal block. As a result, when the spring is inserted in, the terminal block deforms under a resilient force of the spring, thus compromising the structural strength and stability of a connected terminal. Furthermore, in order to produce the bent structure of the conventional wiring terminal, there are more residues and waste generated during the production process, which is a problem that causes an increase in the production cost and should be resolved.

Accordingly, the inventor made various studies to solve the above-mentioned problems, on the basis of which the present invention is accomplished.

SUMMARY

It is an object of the present invention to provide a clamping wire structure of a terminal block, wherein an insertion base of the clamping wire structure is a close-type frame to increase the structural stability of a connected terminal and facilitate easy assembly.

It is another object of the present invention to provide a clamping wire structure of a terminal block, which effects a considerable saving in material and reduces a production cost.

Accordingly, the present invention provides a clamping wire structure of a terminal block, comprising an insertion base and a spring. The insertion base includes a first conductor. The first conductor includes an insertion slot, a contact section disposed at one side of the insertion slot, a linking piece and a first connection portion disposed at the other side of the insertion slot, an extension element, and a conductive pin. The extension element includes a connection slot. The first conductor bends to position the insertion slot correspondingly above the extension element, and the linking piece is inserted in the connection slot, so that the insertion slot and the extension element surroundingly form an insertion space. The spring includes a second conductor. The second conductor is bent into a V-shaped spring. The second conductor has an adjustment portion and a second connection portion. The spring is inserted in the insertion space. The second connection portion is fixed on the first connection portion, and the adjustment portion is in resilient contact with the contact section by a resilient restoring force of the spring.

Compared to the conventional techniques, the clamping wire structure of the terminal block includes the insertion base and the spring. The insertion base and the spring are respectively directly formed by the first conductor and the second conductor, thus saving a material. Furthermore, two ends of the first conductor are connected to surroundingly form a close-type frame, thus facilitating assembling the spring and enhancing the structural strength of the insertion base. Accordingly, when the cable is inserted in the insertion base and pressed by the spring, the close-type insertion base can bear a greater resilient force without deformation, thereby improving the practical use.

BRIEF DESCRIPTION OF THE DRAWINGS

The disclosure will become more fully understood from the detailed description and the drawings given herein below are for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
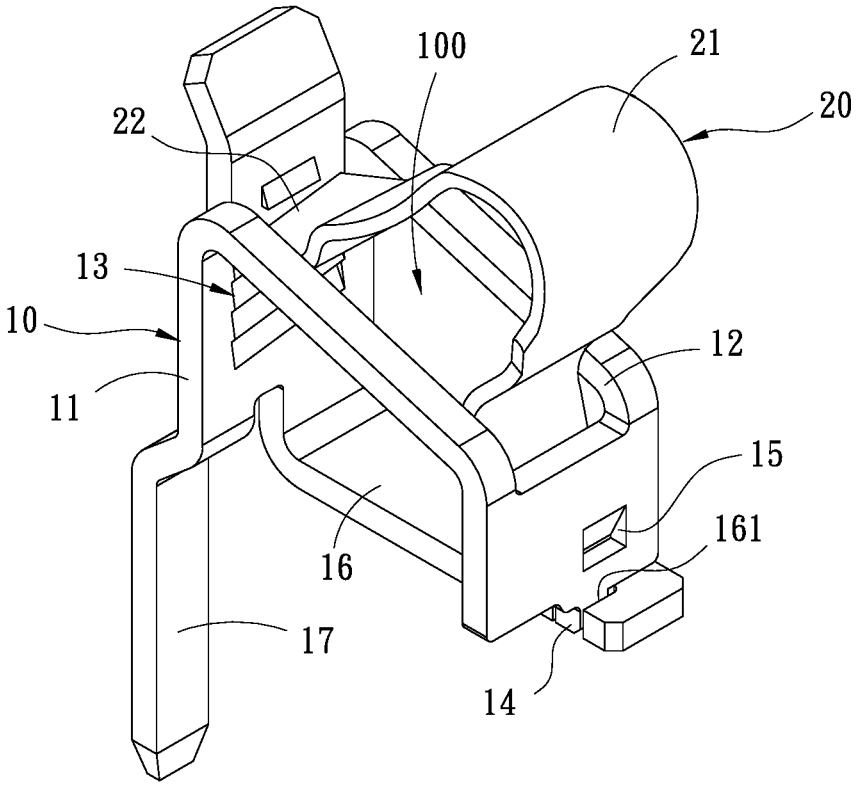
FIG. 1 is a perspective assembled view of the present invention, illustrating a clamping wire structure of a terminal block.
Figure 2:
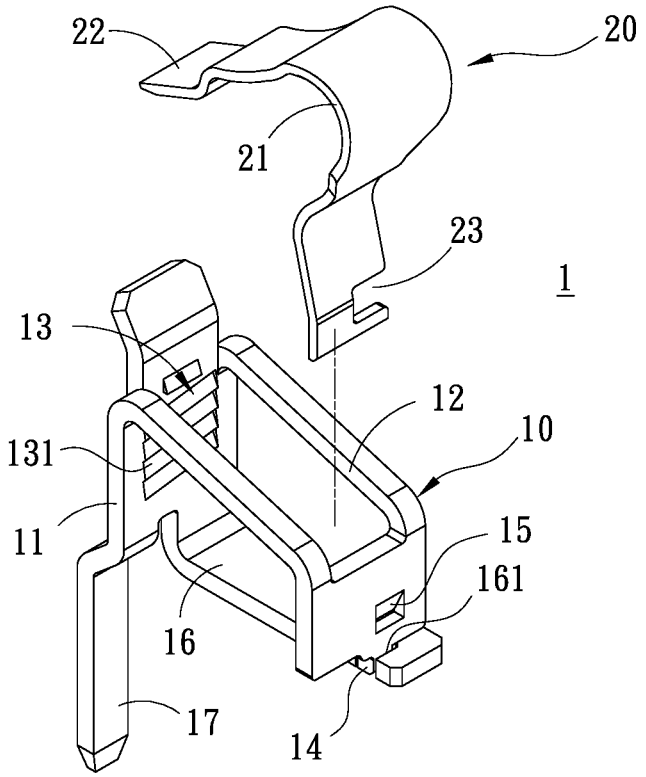
FIG. 2 is a perspective exploded view of the present invention, viewed laterally from one direction, illustrating the clamping wire structure of the terminal block.
Figure 3:
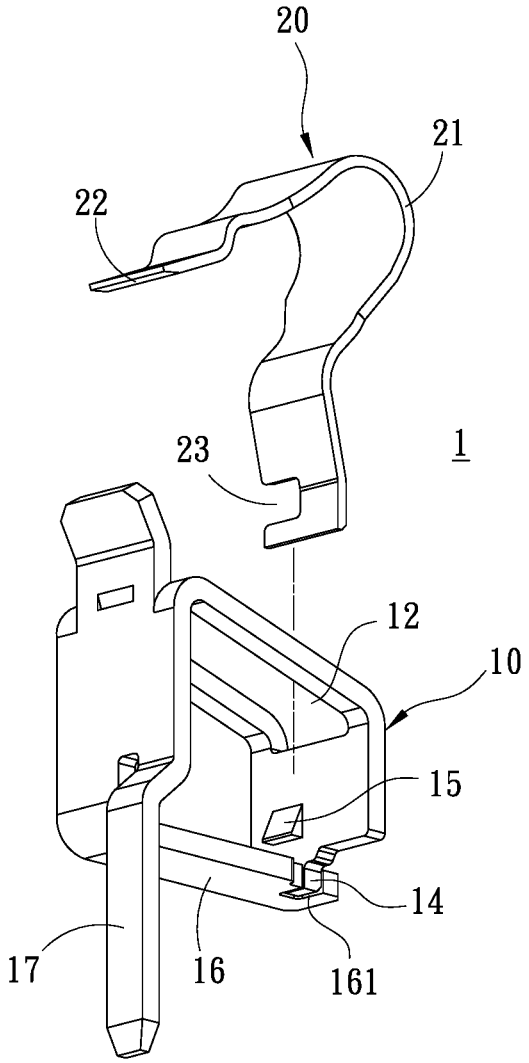
FIG. 3 is a perspective exploded view of the present invention, viewed laterally from another direction, illustrating the clamping wire structure of the terminal block.

Please refer to FIGS. 1 to 3, wherein FIG. 1 is a perspective assembled view, and FIGS. 2 and 3 are two perspective exploded views viewed laterally from different directions. The clamping wire structure 1 of a terminal block comprises an insertion base 10 and a spring 20. One end of the spring 20 is connected to one side of the insertion base 10, and the other end is in resilient contact with the insertion base 10. The structures of the insertion base 10 and the spring 20 are detailed hereinafter.

The insertion base 10 includes a first conductor 11. The first conductor 11 includes an insertion slot 12, a contact section 13 disposed at one side of the insertion slot 12, a linking piece 14 and a first connection portion 15 disposed at the other side of the insertion slot 12, an extension element 16 connected to one side of the contact section 13, and a conductive pin 17.

The extension element 16 has a connection slot 161. The first conductor 11 bends to position the insertion slot 12 correspondingly above the extension element 16. The linking piece 14 is inserted in the connection slot 161, so that the insertion slot 12 and the extension element 16 surroundingly form an insertion space 100. Accordingly, two ends of the first conductor 11 are connected to form a frame, thereby facilitating assembling the spring 20 and enhancing the structural strength of the insertion base 10.

The spring 20 includes a second conductor 21. The second conductor 21 is bent into a V-shaped spring. The second conductor 21 has an adjustment portion 22 and a second connection portion 23. The spring 20 is inserted in the insertion space 100 of the insertion base 10. The second connection portion 23 is fixed on the first connection portion 15. The adjustment portion 22 is in resilient contact with the contact section 13 by a resilient restoring force of the spring 20.

It should be noted that, the insertion base 10 and the spring 20 of the present invention are respectively directly formed and constituted by the first conductor 11 and the second conductor 21, thus effecting a considerable saving in material.

According to one embodiment of the present invention, the insertion slot 12 is rectangular shaped. Furthermore, the contact section 13 includes a plurality of friction ribs 131. The adjustment portion 22 is in contact against one of the friction ribs 131. It should be noted that, when an outside cable is inserted into the insertion slot 12, it contacts one side of the contact section 13 and touches the friction ribs 131. The friction ribs 131 serve to provide friction, thus preventing the outside cable from moving out of the insertion slot 12.

Furthermore, the first connection portion 15 is a bump, the second connection portion 23 is an opening, and the bump is positioned in the opening. Furthermore, the bump and the opening can be welded together to enhance the combination effect therebetween.

Moreover, the conductive pin 17 extends in a direction perpendicular to the extension element 16 and is disposed at one side of the contact section 13. However, in practice, the position and the extending direction of the conductive pin 17 can vary according to conditions; the present invention is not limited in this regard.

Figure 4:
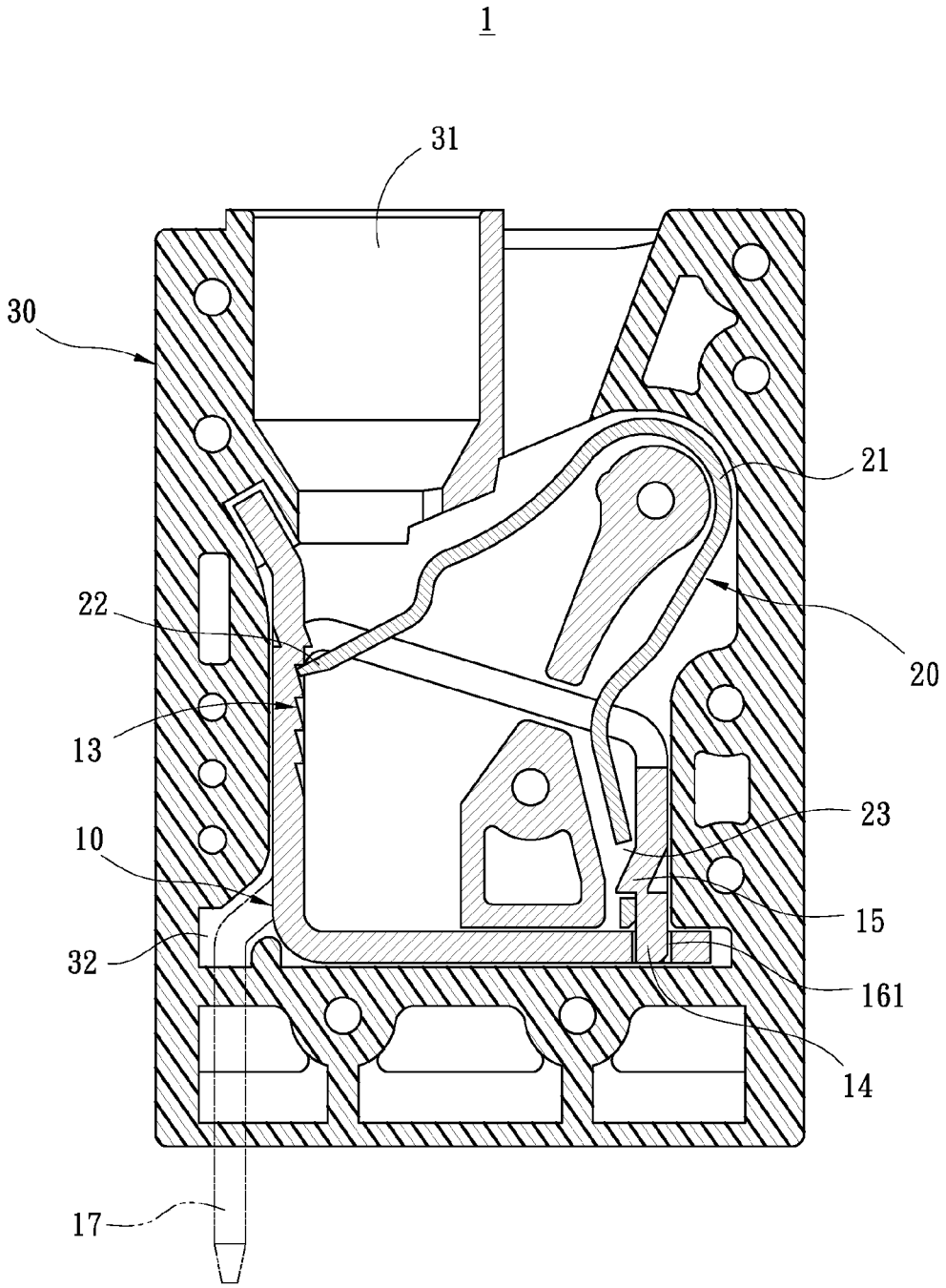
FIG. 4 is a schematic view of the present invention, illustrating an application of the clamping wire structure of the terminal block.

Please refer to FIG. 4 which is a schematic view of the present invention, illustrating an application of the clamping wire structure of the terminal block in use. The clamping wire structure 1 of the terminal block further includes an insulation base 30. The insulation base 30 includes an insertion opening 31 and a pin container 32. The insertion base 10 and the spring 20 are disposed in the insulation base 30. The insertion slot 12 is disposed corresponding to the insertion opening 31. The conductive pin 17 penetrates out of the pin container 32 to be electrically connected to a circuit board (not illustrated).

Figure 5:
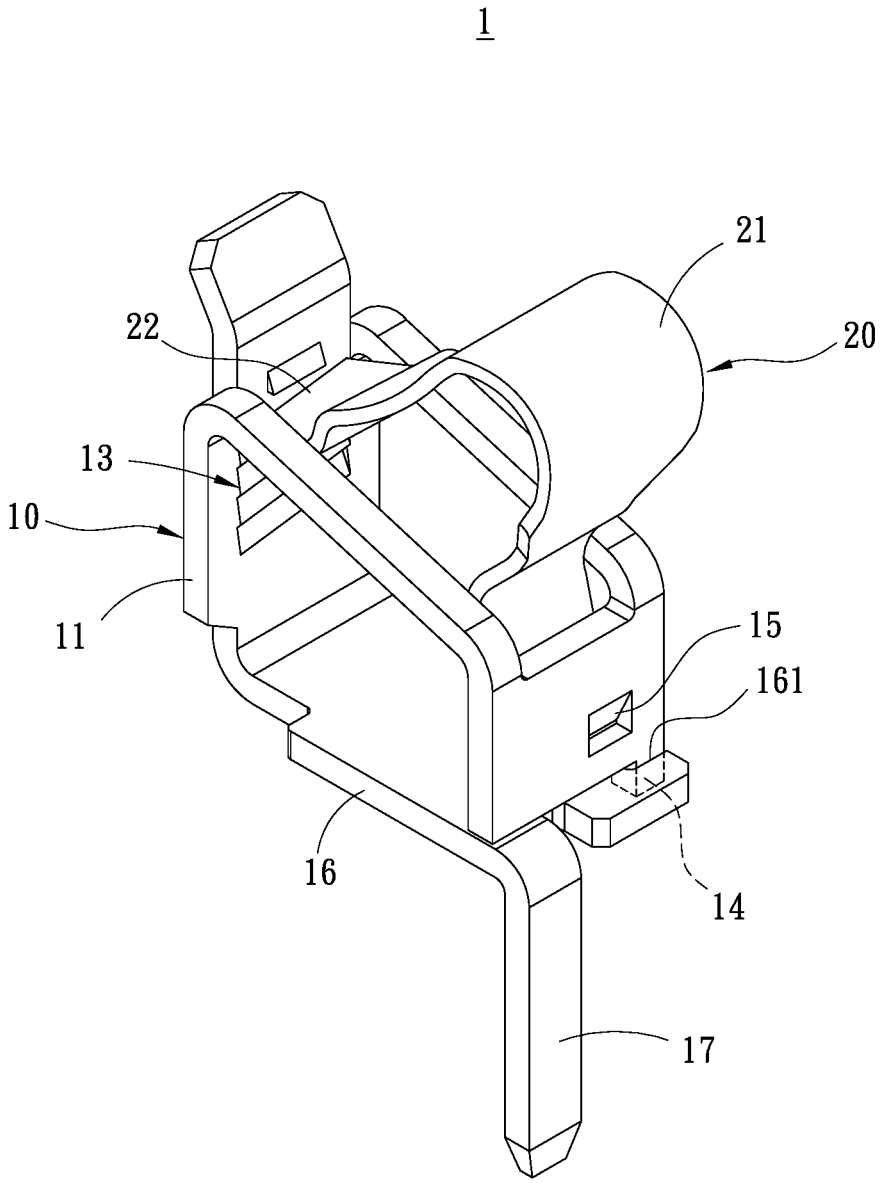
FIG. 5 is a schematic view illustrating the clamping wire structure of the terminal block according to another embodiment of the present invention.
Figure 6:
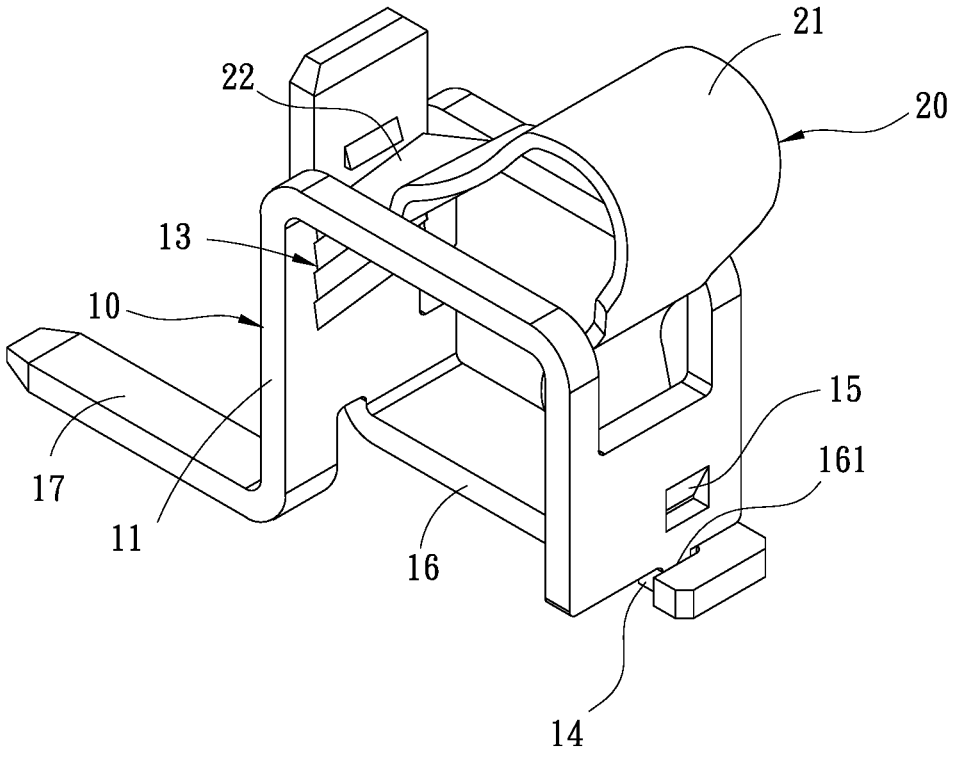
FIG. 6 is a schematic view illustrating the clamping wire structure of the terminal block according to still another embodiment of the present invention.
Figure 7:
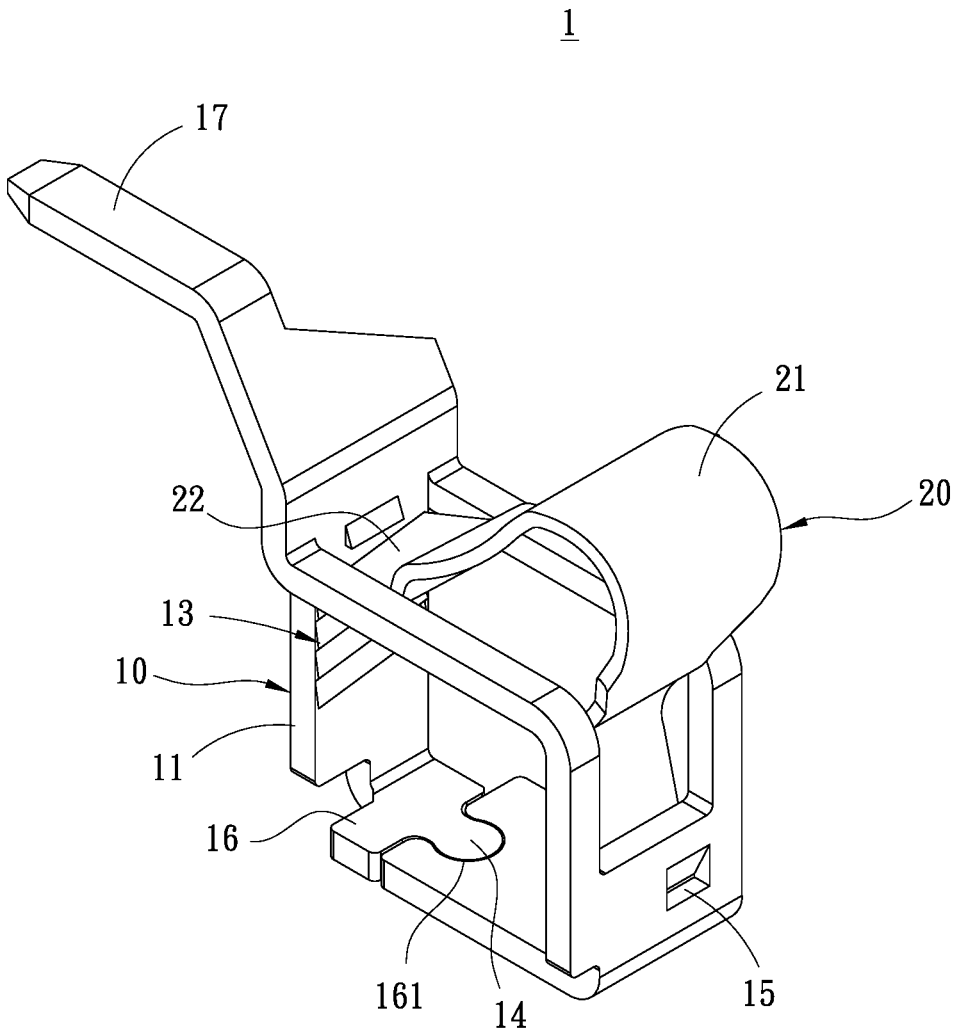
FIG. 7 is a schematic view illustrating the clamping wire structure of the terminal block according to yet another embodiment of the present invention.

Please refer to FIGS. 5 to 7 illustrating the clamping wire structure of the terminal block according to other embodiments. These embodiments are similar to the foregoing embodiment with the difference being the configuration of the conductive pin 17.

As shown in FIG. 5, the insertion base 10 similarly has the insertion slot 12, the contact section 13, and the linking piece 14, the first connection portion 15, the extension element 16, the connection slot 161, and the conductive pin 17. In the present embodiment, the conductive pin 17 extends in a direction perpendicular to the extension element 16 and is disposed at one side of the insertion slot 12. Please refer to FIG. 6. In the embodiment shown in FIG. 6, the conductive pin 17 extends in a direction parallel to the extension element 16 and away from the insertion slot 12, and is disposed at one side of the contact section.

Furthermore, in FIG. 7, the conductive pin 17 is disposed at one side of the contact section 13 and extends in an oblique direction away from the insertion slot 12. The linking piece 14 is a dovetail part, and the connection slot 161 is a dovetail groove, thereby enhancing the combination effect between the linking piece 14 and the connection slot 161.

It is to be understood that the above descriptions are merely the preferable embodiments of the present invention and are not intended to limit the scope of the present invention. Equivalent changes and modifications made in the spirit of the present invention are regarded as falling within the scope of the present invention.

What is claimed is:

1. A clamping wire structure of a terminal block, comprising:

an insertion base (10) including a first conductor (11), the first conductor (11) including an insertion slot (12), a contact section (13) disposed at one side of the insertion slot (12), a linking piece (14) and a first connection portion (15) disposed at the other side of the insertion slot (12), an extension element (16), and a conductive pin (17), the extension element (16) including a connection slot (161), the first conductor (11) bending to position the insertion slot (12) correspondingly above the extension element (16), the linking piece (14) being inserted in the connection slot (161) to make the insertion slot (12) and the extension element (16) surroundingly form an insertion space (100); and a spring (20) including a second conductor (21), the second conductor (21) being bent into a V-shaped spring, the second conductor (21) having an adjustment portion (22) and a second connection portion (23), the spring (20) being inserted in the insertion space (100), the second connection portion (23) being fixed on the first connection portion (15), the adjustment portion (22) being in resilient contact with the contact section (13) by a resilient restoring force of the spring (20).

2. The clamping wire structure of the terminal block of claim 1, wherein the insertion slot (12) is of rectangular shape.

3. The clamping wire structure of the terminal block of claim 1, wherein the contact section (13) includes a plurality of friction ribs (131), the adjustment portion (22) is in contact against one of the friction ribs (131).

4. The clamping wire structure of the terminal block of claim 1, wherein the first connection portion (15) is a bump, and the second connection portion (23) is an opening.

5. The clamping wire structure of the terminal block of claim 1, wherein the conductive pin (17) extends in a direction perpendicular to the extension element (16) and is disposed at one side of the contact section (13).

6. The clamping wire structure of the terminal block of claim 1, wherein the conductive pin (17) extends in a direction perpendicular to the extension element (16) and is disposed at one side of the insertion slot (12).

7. The clamping wire structure of the terminal block of claim 1, wherein the conductive pin (17) extends in a direction parallel to the extension element (16) and away from the insertion slot (12), and is disposed at one side of the contact section (13).

8. The clamping wire structure of the terminal block of claim 1, wherein the conductive pin (17) is disposed at one side of the contact section (13) and extends in an oblique direction away from the insertion slot (12).

9. The clamping wire structure of the terminal block of claim 1, further comprising an insulation base (30), the insulation base (30) including an insertion opening (31) and a pin container (32), the insertion base (10) and the spring (20) being disposed in the insulation base (30), the insertion slot (12) being disposed corresponding to the insertion opening (31), the conductive pin (17) penetrating out of the pin container (32).

* * * * *